US011473247B2

(12) United States Patent
Bergk et al.

(10) Patent No.: US 11,473,247 B2
(45) Date of Patent: Oct. 18, 2022

(54) SWITCH DEVICE

(71) Applicants: VOESTALPINE BWG GMBH, Butzbach (DE); VOESTALPINE VAE GMBH, Vienna (AT)

(72) Inventors: Thomas Bergk, Gotha (DE); Thomas Christ, Erfurt (DE); Jürgen Hellbach, Günthersleben-Wechmar (DE); Torsten Nolte, Erfurt (DE)

(73) Assignees: VOESTALPINE BWG GMBH, Butzbach (DE); VOESTALPINE VAE GMBH, Vienna (AT)

( * ) Notice: Subject to any disclaimer, the term of this patent is extended or adjusted under 35 U.S.C. 154(b) by 183 days.

(21) Appl. No.: 16/648,313

(22) PCT Filed: Sep. 10, 2018

(86) PCT No.: PCT/EP2018/074291
§ 371 (c)(1),
(2) Date: Mar. 18, 2020

(87) PCT Pub. No.: WO2019/057532
PCT Pub. Date: Mar. 28, 2019

(65) Prior Publication Data

US 2020/0217019 A1 Jul. 9, 2020

(30) Foreign Application Priority Data

Sep. 19, 2017 (DE) ..... 20 2017 105 682.1
Nov. 23, 2017 (DE) ..... 20 2017 107 122.7

(51) Int. Cl.
*E01B 7/02* (2006.01)
*E01B 11/42* (2006.01)
*B21K 7/04* (2006.01)

(52) U.S. Cl.
CPC ..... *E01B 7/02* (2013.01); *E01B 11/42* (2013.01); *B21K 7/04* (2013.01);
(Continued)

(58) Field of Classification Search
CPC ... B61L 5/10; B61L 5/02; B61L 5/026; B21K 7/04; E01B 7/00; E01B 7/02; E01B 7/06;
(Continued)

(56) References Cited

U.S. PATENT DOCUMENTS 5,100,046 A * 3/1992 Allegrucci ..... E01B 7/00 228/170
5,451,018 A * 9/1995 Heinze ..... E01B 7/02 246/436

(Continued)

FOREIGN PATENT DOCUMENTS

CN 2187191 Y 1/1995
CN 2501906 Y 7/2002

(Continued)

OTHER PUBLICATIONS

Chinese Office Action, dated Feb. 19, 2021, for Chinese Application No. 201880060893.5.

(Continued)

*Primary Examiner* — S. Joseph Morano
*Assistant Examiner* — Cheng Lin
(74) *Attorney, Agent, or Firm* — Ladas & Parry LLP; Malcolm J. MacDonald

(57) ABSTRACT

A grooved rail switch device (10) having a switch rail (12), the switch device having a monobloc design and comprising at least one stock rail (14), a junction rail (18) and a switch rail support (23), and the switch rail (12) and the junction rail (18) being mechanically interconnected. The switch rail (12) and the junction rail (18) merge into each other by means of a joint (20) that is S-shaped in the horizontal section.

8 Claims, 2 Drawing Sheets

Figures 1, 2, 3, 4, 5, 6, 7:
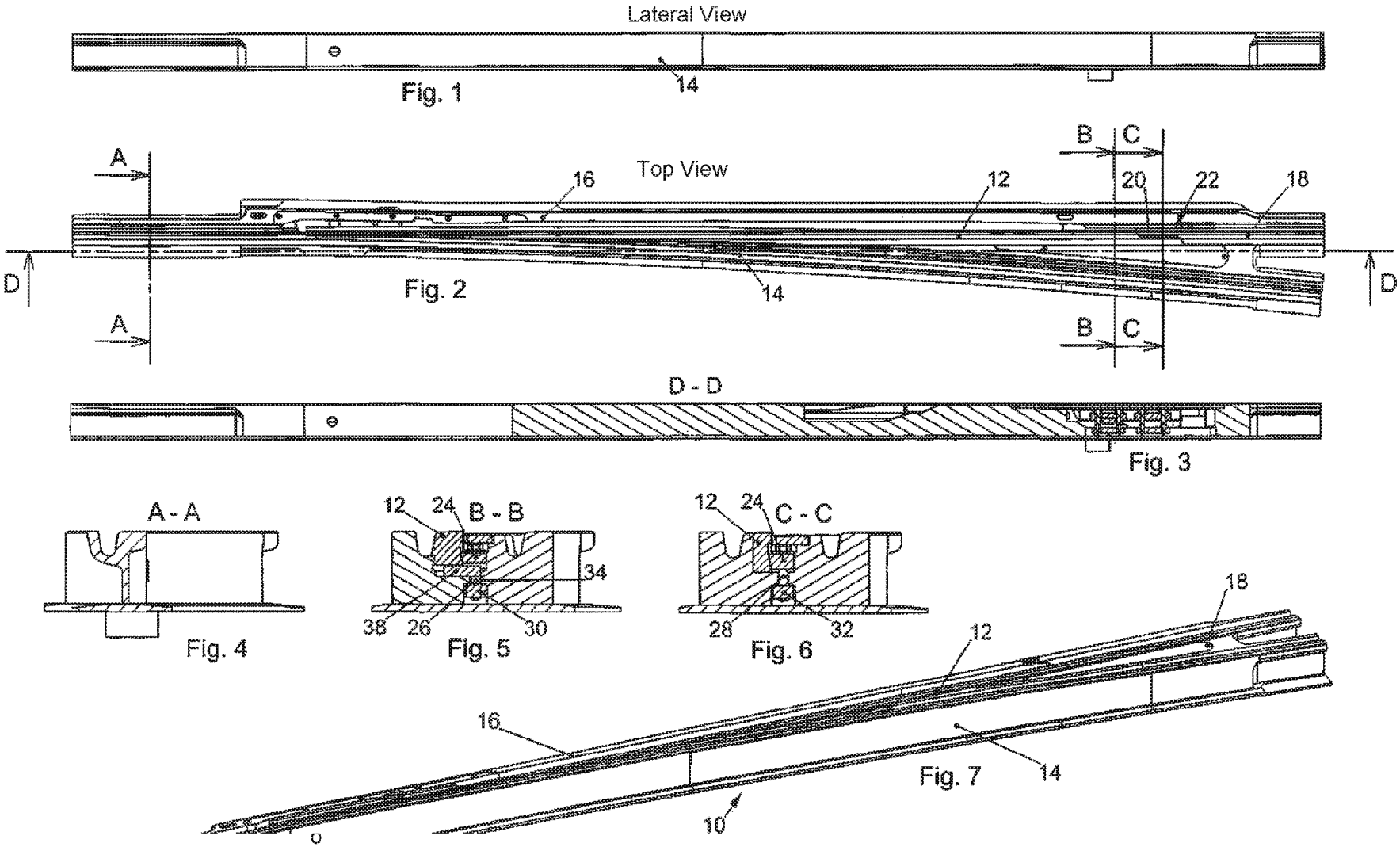

(52) U.S. Cl.
CPC ..... *E01B 2202/042* (2013.01); *E01B 2202/06* (2013.01); *E01B 2202/08* (2013.01)

(58) Field of Classification Search
CPC ..... E01B 7/08; E01B 11/42; E01B 2202/00; E01B 2202/02; E01B 2202/021; E01B 2202/04; E01B 2202/042; E01B 2202/06; E01B 2202/08; E01B 11/24; E01B 7/14
See application file for complete search history.

(56) References Cited

U.S. PATENT DOCUMENTS

| | | | | |
|---|---|---|---|---|
| 7,309,050 | B2 * | 12/2007 | Heinze | E01B 7/12 246/460 |
| 7,740,208 | B2 | 6/2010 | Mugg | |
| 8,302,879 | B2 * | 11/2012 | Christ | E01B 11/42 238/171 |
| 9,243,370 | B2 * | 1/2016 | Christ | B21D 47/00 |
| 10,260,202 | B2 * | 4/2019 | Bemment | E01B 7/08 |
| 2004/0113023 | A1 * | 6/2004 | Benenowski | E01B 7/06 246/435 R |

FOREIGN PATENT DOCUMENTS

| | | | | |
|---|---|---|---|---|
| CN | 204738187 | U | 11/2015 | |
| CN | 105735060 | A | 7/2016 | |
| CN | 206408464 | U | 8/2017 | |
| DE | 44 10 200 | C1 | 7/1995 | |
| DE | 4410200 | C1 * | 7/1995 | E01B 7/02 |
| DE | 101 24 624 | A1 | 10/2002 | |
| DE | 102016009976 | B3 * | 9/2017 | E01B 7/02 |
| EP | 0567052 | A1 | 10/1993 | |
| EP | 2 312 052 | A2 | 4/2011 | |
| RU | 33606 | U1 | 10/2003 | |
| RU | 152256 | U1 | 5/2015 | |

OTHER PUBLICATIONS

Taiwan Office Action, dated Mar. 26, 2021, for Taiwan Application No. 107132472.
International Search Report dated Dec. 11, 2018, corresponding to International Application No. PCT/EP2018/074291.
Non-English Decision of Grant, dated Sep. 10, 2020, corresponding to Russian Patent Application No. 2020113703.

* cited by examiner

Lateral View
14

Top View
18
22
20
B
C
12
14
16
A
D

D - D

A - A

B - B
24
12
34
30
26
38

C - C
24
12
32
28

18
12
14
16
10

SWITCH DEVICE

The invention relates to a grooved rail switch device in monobloc design with a switch rail, whereby the switch device is manufactured as a monobloc and comprises at least one stock rail, one connecting rail, and one switch rail support, and whereby the switch rail and the connecting rail are mechanically connected to one another.

In the context of characteristic features, the terms stock rail, connecting rail, side rail are meant to also encompass a respective portion of a side rail, connecting rail, and stock rail.

Switch devices in monobloc design have been comprehensively tried and tested. Corresponding switch devices can for example be found in DE 101 24 624 C2 or DE 40 11 523 A1. In this, the switch devices may be produced from a uniform material, or may comprise an upper part consisting of high-strength steel and a lower part that may for example consist of construction steel. The upper part comprises the switch support in which the switch rail is adjustably arranged. Thus the switch support comprises the stock rail, the switch rail support, which may also be referred to as slide plate, as well as at least one side rail. A further component of the switch device is a section of a connecting rail or standard rail, using which the switch rail is connected within the switch device. Mechanical connections have prevailed for this, whereby the switch rail and the connecting rail merge into one another via a butt joint. On both sides of the joint extend mechanical connecting elements, such as brackets, which are connected to one another via bolts passing through the rails. Using a butt joint entails the disadvantage of an abrupt wheel transition, which results in the edges of the joint being subjected to wear and tear by the wheels. This creates wheel-transition problems, which among other issues affects the travel comfort.

To avoid this disadvantage, it is known in the art that the switch rail and the connecting rail merge into each other via an oblique joint (EP 0 603 883 A1, DE 42 44 010 A1). This however entails the disadvantage that the tips of switch rail and connecting rail may break, which necessitates frequent inspections and possibly rail maintenance and repair measures.

In switch devices in monobloc design, the switch rail and the connecting rail can be mechanically connected to one another in a friction-locked manner via a clamping device, a so-called tongue rail adapter (DE 101 14 683 A1).

Also known in the art are monobloc designs in which the bloc extends over the length of the switch support as well as along one side beyond the switch support (see DE 10 2010 037 110 A1).

The objective of the present invention is to further develop a switch device of the above-mentioned type in a way to provide high riding comfort during passage over the switch device. A further objective is to reduce wear-and-tear compared to the present state of the art in the wheel transition area between the switch rail and the connecting rail.

To meet this objective, the invention fundamentally intends that the switch rail and the connecting rail are interconnected via a joint that exhibits an S-shape in a horizontal section.

According to the invention, a switch device manufactured in monobloc design employs an S-shaped joint to connect the connecting rail to the switch rail, which simplifies and improves the connection between the rail sections. The shape of the joint improves riding comfort for trains traveling over it. This provides a low-wear wheel transition area, with a stability that is caused in particular by its obtuse-angled S-shape and, in comparison to oblique joints, the lack of pointed material edges. At the same time, the S-joint ensures that a two-part wheel bearing surface is available over the length of the section of the S-joint extending along the longitudinal direction of the rail groove, which substantially prevents the fracturing edges or other damage.

Nevertheless, one retains the advantages of monobloc grooved rail switch devices with respect to the selection of desired materials for switch rail and connecting rail, and one also still has the option of exchanging the switch rail in a simple manner because of the mechanical connection, i.e. the mounting is accomplished by clamping in a so-called switch adapter. In this, the switch rail in particular is fixed by wedge elements, as is disclosed in for example DE 42 44 010 A1 and EP 0 603 883 A1, the disclosure of which is expressly referred to.

It is known in the art for Vignoles rails to embody an S-joint between the switch rail and the connecting rail, as shown in DE 44 10 200 C1. However, the switch rail is connected to the connecting rail by welding, which results in constraints in the selection of rail materials. Also, exchanging the switch rail is time-consuming and consequently cost-intensive.

In particular it is intended that in the monobloc, on the end-face area of the connecting rail, a contact surface with an S-shape is machined, e.g. routed, which is in contact with a geometrically corresponding mating surface of the switch rail, to form the s-shaped joint.

Preferably, the longitudinal limb of the joint extending in the longitudinal direction of the connecting rail is 5 to 15 times longer than the respective transverse limb of the joint that originates from the longitudinal limb of the joint.

The invention further is characterized in that the S-shaped joint consists of a longitudinal member extending in the longitudinal direction of the connecting rail and of transverse members, which possess a curved shape.

To create a simple yet secure connection, the invention intends that the switch rail is connected in a friction-locked manner to the connecting rail via a wedge element, such as a wedge clamping plate.

For this purpose, a T-groove can extend along the longitudinal direction of the switch device to accept one or several nuts of one or several bolts, which can be used to tighten the wedge element to connect the switch rail to the connecting rail in a friction locked manner.

Further, at least in its section comprising the stock rail, the connecting rail, the side rail, and the switch rail support, the monobloc should consist of high-strength steel, bainite, austenitic manganese steel, hardened and tempered rail steel (R350HT), hardened and tempered fine-grained structural steel, e.g. Dilidur, Hardox, XAR, with the steel grades 400-500.

To reliably prevent a longitudinal movement of the switch rail, the invention further provides that the switch rail is secured against a motion in the longitudinal direction by a rail anchor, which sectionally extends both in the switch rail support and in the switch rail.

Further details, advantages, and features of the invention are not only found in the claims, the characteristic features specified therein—individually and/or in combination—but also in the following description of a preferred embodiment example.

Figure 8:
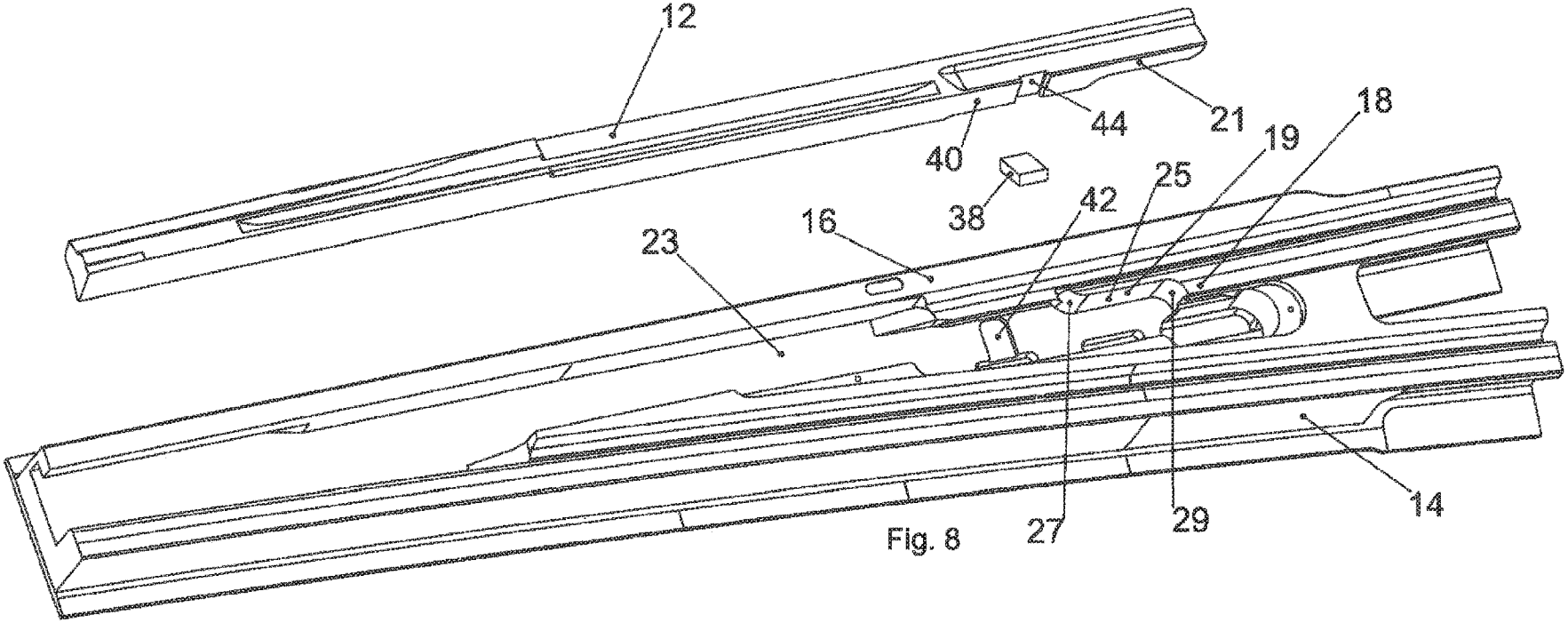

The figures show:

FIG. 1 shows a lateral view of a switch device with a switch rail,

FIG. 2 shows a top view onto a switch device of FIG. 1 with a switch rail, FIG. 3 shows a sectional view along the line D-D of FIG. 2, FIG. 4 shows a sectional view along the line A-A of FIG. 2, FIG. 5 shows a sectional view along the line B-B of FIG. 2, FIG. 6 shows a sectional view along the line C-C of FIG. 2, FIG. 7 shows an elevation in perspective view, and FIG. 8 shows a further embodiment of the invention's switch device in an expanded view.

The figures, in which identical elements always carry the same reference labels, show a switch device 10 with a switch rail 12. The switch device 10 is produced in monobloc fashion, i.e. as one part. However in this the term one-part includes the possibility that the lower part of the switch device 10 is produced of a different material than the upper part, which in particular consists of high-strength steel. Nevertheless this is a monobloc design, since the areas that are subjected to high wear and tear are embodied in one piece and in particular consist of high-strength steel. The monobloc may be manufactured from a monolithic bloc by routing.

The switch device 10 comprises a stock rail 14, a side rail 16, a portion of a connecting rail 18, as well as a slide plate 23, also to be referred to as switch rail support, upon which the switch rail 12 is adjustably arranged. The reader is referred to designs known in the art.

In its root area, the switch rail 12 is mechanically connected to the connecting rail 18, in particular via an S-joint, as illustrated in the top view of FIG. 2. For this, a region is milled out of the monobloc, in particular from the end face of the connecting rail section 18, in order to provide an S-shaped contact surface 19, if viewed in a horizontal section, which is in surface contact with a geometrically matching contact surface 21 of the switch rail root (FIG. 4). This is illustrated by an S-shaped line 22 in the top view. The joint faces extend along the vertical axis of the monobloc.

For the purpose of connecting the switch rail 12 to the connecting rail 18 in a friction-locked manner, wedge clamping elements 24 are provided, as shown in the sectional views in FIGS. 5 and 6, which can be tightened using the bolts 26, 28 towards the bottom of the switch device 10, in order to generate the desired clamping action and thus the friction-locked connection. For tightening, the bolts with their threads engage into nuts 30, 32, which are situated in T-shaped grooves that extend in the bottom area of the switch device 10. The corresponding groove is marked with the reference label 34 in FIGS. 5 and 6.

In order to prevent a longitudinal motion of the switch rail 12, a rail anchor 38 may be provided, which engages both into the slide plate 20 and into the facing base 40 of the switch rail 12. For this purpose, corresponding respective recesses 42, 44 are provided in the slide plate 20 and the base 40 of the switch rail 12.

In this, the rail anchor 38 extends in the immediate vicinity of the joint 20, i.e. in an area in which the switch rail 12 is not curved or at least not substantially curved.

FIG. 8 again shows the grooved rail switch device in monobloc design, in an enlarged illustration, with the switch rail 12 removed and rotated by 90 degrees around its longitudinal axis. Easily discernible is the S-shaped contact surface 19 for the S-joint that has been machined out in the connecting rail section 18, whereby the section that extends in the longitudinal direction of the connecting rail is 5 to 15 times longer than the respective transverse limb, which originates from the longitudinal limbs and which extends in a curved manner, as is shown in the figure. Also shown is the recess 42 in the slide plate 23, into which is inserted the rail anchor 38, which sectionally extends in the sliding plate 23 and the switch rail 12.

The extent of the contact surface 19 and the correspondingly matched contact surface 21 in the switch rail root give shape to the S-joint, which consists of the longitudinal member extending along the longitudinal direction of the connecting rail 18, and of the transverse members originating from the ends of the longitudinal member.

Consequently, the contact surface 29 and correspondingly the contact surface 21 in the switch rail root comprises a longitudinal section 25 extending in the longitudinal direction of the connecting rail 18, and originating from the ends of said longitudinal section, comprises sections 27, 29, which extend in a curved manner.

On account of the length of the section 25, i.e. the longitudinal member of the S-joint 20, one achieves a comparatively long two-part wheel contact surface, which enhances riding comfort. Two-part wheel contact surfaces of this nature cannot be implemented for an oblique joint.

The invention claimed is:

1. A grooved rail switch device, comprising:

a stock rail, a connecting rail, and a switch rail support manufactured in one part as a monobloc; and a switch rail;

wherein the switch rail and the connecting rail are connected to one another by a friction-lock connection;

wherein the switch rail and the connecting rail merge into one another via a joint that is S-shaped along a horizontal section;

wherein the switch rail is secured against movement in the longitudinal direction by a rail anchor that extends sectionally in the switch rail support and in the switch rail; and wherein the rail anchor extends adjacent to the S-shaped joint.

2. The switch device according to claim 1, wherein, the end-faced area of the connecting rail comprises a machined contact surface having an S-shape, wherein the machined contact surface is in contact with a geometrically corresponding mating surface of the switch rail, and forms the S-shaped joint.

3. The switch device according to claim 1, wherein the S-shaped joint consists of one longitudinal limb extending along the longitudinal direction of the connecting rail, and transverse limbs that extend curved.

4. The switch device according to claim 3, wherein the longitudinal limb of the joint extending in the longitudinal direction of the connecting rail is 5 to 15 times longer than a transverse limb of the joint originating from said longitudinal limb.

5. The switch device according to claim 1, wherein the switch rail is connected to the connecting rail via a wedge element.

6. The switch device according to claim 1, wherein, in the longitudinal direction of the switch device, extends a T-slot for accepting one or several nuts of one or several bolts, via which, the wedge element can be tightened to connect the switch rail with the connecting rail in a mechanical friction-locked manner.

7. The switch device according to claim 1, wherein the monobloc, at least in an area of the monobloc that comprises the stock rail, the connecting rail, and the switch rail support consists of high-strength steel.

8. The switch device according to claim 7, wherein the high-strength steel is selected from the group consisting of bainite, austenitic manganese steel, hardened and tempered rail steel, and hardened and tempered fine-grained structural steel.

* * * * *